US005243306A

United States Patent [19]

Minowa et al.

[11] Patent Number: 5,243,306

[45] Date of Patent: Sep. 7, 1993

[54] SEPARATE TYPE BRANCHING FILTER

[75] Inventors: Yoshio Minowa; Yuhei Kosugi; Motoyuki Hitotsuyanagi, all of Tokyo, Japan

[73] Assignee: NEC Corporation, Japan

[21] Appl. No.: 845,144

[22] Filed: Mar. 3, 1992

[30] Foreign Application Priority Data

Mar. 4, 1991 [JP] Japan ..... 3-064075
Apr. 30, 1991 [JP] Japan ..... 3-126871

[51] Int. Cl.[5] ..... H01P 1/209
[52] U.S. Cl. ..... 333/135; 333/208
[58] Field of Search ..... 333/126, 135, 239, 208

[56] References Cited

U.S. PATENT DOCUMENTS 4,458,217 7/1984 Wong et al. ..... 333/126 X
4,783,639 11/1988 Hudspeth et al. ..... 333/126

FOREIGN PATENT DOCUMENTS 158901 7/1988 Japan ..... 333/135
303801 12/1989 Japan ..... 333/135

*Primary Examiner*—Paul Gensler
*Attorney, Agent, or Firm*—Laff, Whitesel, Conte & Saret

[57] ABSTRACT

In a branching filter, a transmit filter (14) is divided into first and second transmit filter parts (17, 18). A waveguide branching filter (15) is divided into first and second branching filter parts (19, 20). A receive filter (16) is divided into first and second receive filter parts (21, 22). The first transmit filter part is assembled with the second branching filter part and the second receive filter part. The second branching filter part is assembled with the second receive filter part. The first branching filter part is assembled with the first receive filter part. Alternative assembly is possible. As a further alternative, an installation hole may be formed in the branching filter for removable installation of a cable and be covered with a cover with a packing interposed for hermetic seal and waterproofing.

7 Claims, 6 Drawing Sheets

SEPARATE TYPE BRANCHING FILTER

BACKGROUND OF THE INVENTION

This invention relates to a branching filter and to a transmitter-receiver which comprises a branching filter under consideration. A branching filter has a transmitter port for receiving an input transmit signal, a receiver port, and an antenna port for receiving an input receive signal and is for distributing the input transmit signal to the antenna port and the input receive signal to the receiver port.

A conventional branching filter comprises a transmit filter, a waveguide branching filter coupled to the transmit filter, a curved waveguide coupled to the waveguide branching filter, and a receive filter coupled to the curved waveguide. It is impossible to easily and cheaply produce the conventional branching filter. Inasmuch as the transmit filter is large, the conventional branching filter is large.

A transmitter-receiver comprises a transmitter module, a branching filter module coupled to the transmitter module, and a receiver module coupled to the branching filter module.

In a conventional transmitter-receiver, a transmitter module comprises a transmitter connector. A receiver module comprises a receiver connector. On putting the transmitter-receiver in operation, a cable is connected to the transmitter connector and the receiver connector. Points of connection of the cable to the transmitter connector and the receiver connector are covered for hermetic seal and for insuring waterproofness by a first and a second connector cover. It is hardly possible in the conventional transmitter-receiver to exchange the first and the second connector covers to a new cover.

SUMMARY OF THE INVENTION

It is therefore an object of this invention to provide a branching filter which can be easily and cheaply produced.

It is another object of this invention to provide a small branching filter.

It is a different object of this invention to provide a transmitter-receiver in which it is easily possible to apply a connector cover to each of a transmitter connector and a receiver connector and to remove the cover therefrom.

Other objects of this invention will become clear as the description proceeds.

According to an aspect of this invention, there is provided a branching filter which has a transmitter port for receiving an input transmit signal, a receiver port, and an antenna port for receiving an input receive signal and which comprises a transmit filter, a waveguide branching filter, and a receive filter, wherein: the transmit filter comprises first and second transmit filter parts, the waveguide branching filter comprising first and second branching filter parts, the receive filter comprising first and second receive filter parts, the first transmit filter part being integral with the second branching filter part, the first transmit filter part being integral with the second receive filter part, the second branching filter part being integral with the second receive filter part, the first branching filter part being integral with the first receive filter part; the first and the second transmit filter parts being for filtering the input transmit signal into a filtered transmit signal, the first and the second branching filter parts being for receiving the filtered transmit signal and the input receive signal to distribute the filtered transmit signal to the antenna port and the input receive signal to the receive filter, the first and the second receive filter parts being for passing the input receive signal to the receiver port.

According to another aspect of this invention, there is provided a branching filter which has a transmitter port for receiving an input transmit signal, a receiver port, and an antenna port for receiving an input receive signal and which comprises a transmit filter, a waveguide branching filter, and a receive filter, wherein: the transmit filter comprises first and second transmit filter parts, the first transmit filter part being integral with the waveguide branching filter, the first transmit filter part being integral with the receive filter, the waveguide branching filter being integral with the receive filter; the first and the second transmit filter parts being for filtering the input terminal signal into a filtered transmit signal, the waveguide branching filter being for receiving the filtered transmit signal and the input receive signal to distribute the filtered transmit signal to the antenna port and the input receive signal to the receive filter, the receive filter being for passing the input receive signal to the receiver port.

According to a different aspect of this invention, there is provided a transmitter-receiver comprising a transmitter module for generating an input transmit signal, a branching filter module having an antenna port for receiving an input receive signal, and a receiver module, the branching filter module being for receiving the input transmit signal and the input receive signal to distribute the input transmit signal to the antenna port and the input receive signal to the receiver module, wherein: the transmitter module comprises a transmitter connector, the receiver module comprising a receiver connector, the branching filter module serving as a waveguide branching filter comprising a first branching connector connected to the transmitter connector, a second branching connector connected to the receiver connector, a cover, and a circumferential wall defining an installation hole which is for receiving a cable and is covered with the cover with a packing interposed between the cover and the circumferential wall.

DESCRIPTION OF THE PREFERRED EMBODIMENTS

Figure 1:
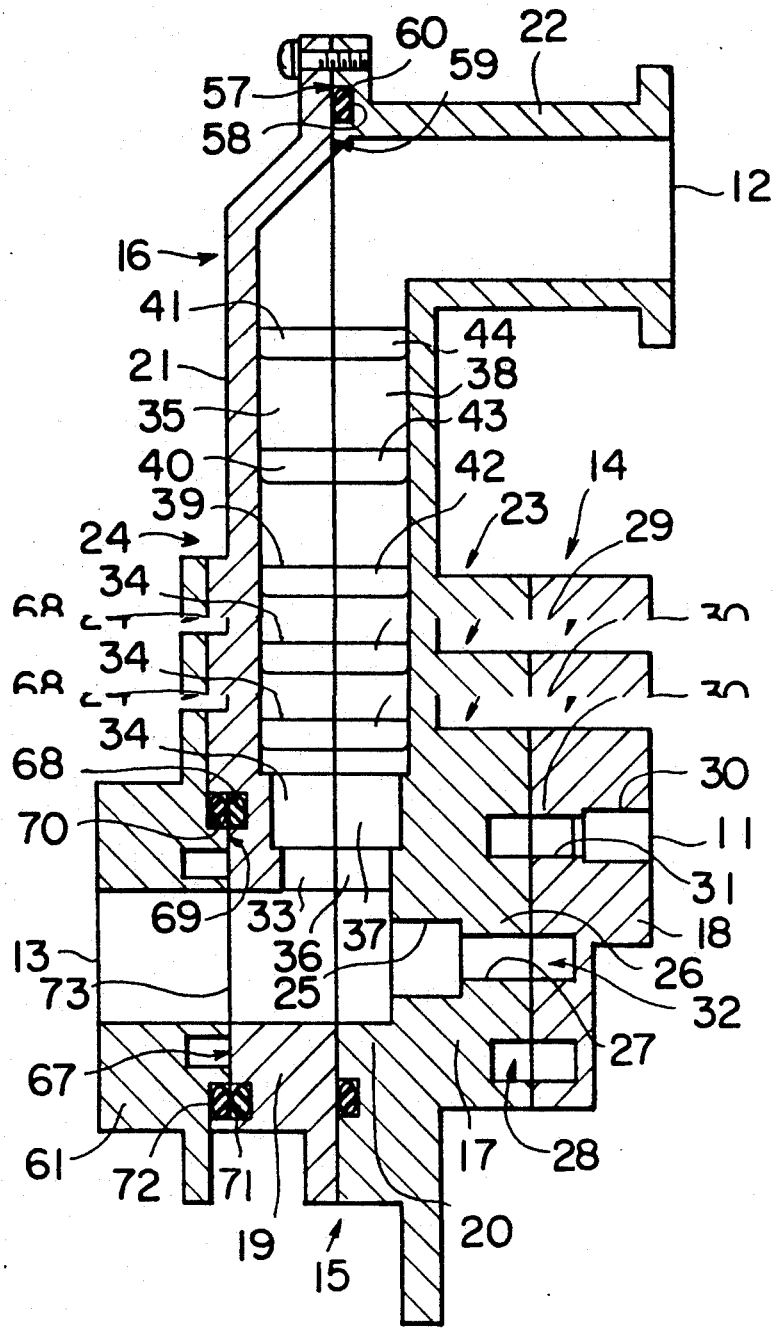
FIG. 1 is a vertical-sectional view of a branching filter according to a first embodiment of this invention.

Referring to FIG. 1, a branching filter according to a preferred embodiment of this invention has a transmitter port 11 for receiving an input transmit signal, a receiver port 12, and an antenna port 13 for receiving an input receive signal. The branching filter comprises a transmit filter 14, a waveguide branching filter 15, and a receive filter 16. The transmit filter 14, the waveguide branching filter 15, and the receive filter 16 are made of, for example, aluminum.

According to this invention, the transmit filter 14 comprises first and second transmit filter parts 17 and 18. The waveguide branching filter 15 comprises first and second branching filter parts 19 and 20. The receive filter 16 comprises first and second receive filter parts 21 and 22. In other words, the transmit filter 14 is divided into the first and the second transmit filter parts 17 and 18. The waveguide branching filter 15 is divided into the first and the second branching filter parts 19 and 20. The receive filter 16 is divided into the first and the second receive filter parts 21 and 22. Each of the transmit filter 14, the waveguide branching filter 15, and the receive filter 16 is divided in this manner into two parts. The reason for the division will later be described.

The first transmit filter part 17 is rendered integral with the second branching filter part 20. The first transmit filter part 17 is integral with the second receive filter part 22. The second branching filter part 20 is integral with the second receive filter part 22. The first branching filter part 19 is integral with the first receive filter part 21. The second receive filter part 22 has the receiver port 12. As a consequence, the illustrated branching filter comprises a first element 23 and a second element 24. The first element 23 comprises the first transmit filter part 17, the second branching filter part 20 and the second receive filter part 22. The second element 24 comprises the first branching filter part 19 and the first receive filter part 21. The second transmit filter part 18 has the transmitter port 11.

The first and the second transmit filter parts 17 and 18 are for cooperatively filtering the input transmit signal into a filtered transmit signal to supply the filtered transmit signal to the first and the second branching filter parts 19 and 20. The first and the second branching filter parts 19 and 20 receive the filtered transmit signal and the input receive signal to distribute the filtered transmit signal to the antenna port 13 and the input receive signal to the first and the second receive filter parts 21 and 22. The first and the second receive filter parts 21 and 22 are for collectively filtering the input receive signal into a filtered receive signal to supply the filtered receive signal to the receiver port 12.

The first transmit filter part 17 has a first transmit impedance transducer 25 which is in communication with the second branching filter part 20, and a first cut-off waveguide 26 connected to the first transmit impedance transducer 25.

Figure 2:
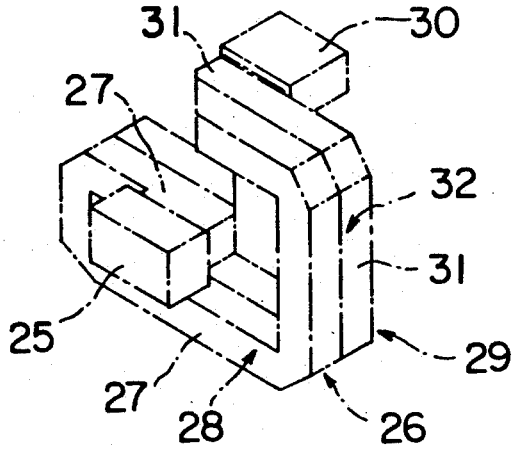
FIG. 2 is an imaginary perspective view of first and second spiral waveguide passageways of the branching filter illustrated in FIG. 1.

Turning temporarily to FIG. 2, the first cut-off waveguide 26 has a first inner side surface 27 which defines a first spiral waveguide passageway 28.

Turning back to FIG. 1, the second transmit filter part 18 has a second cut-off waveguide 29 coupled to the first cut-off waveguide 26, and a second transmit impedance transducer 30 integrated to the second cut-off waveguide 29. The transmitter port 11 is integrated to the second transmit impedance transducer 30.

Turning again to FIG. 2, the second cut-off waveguide 29 has a second inner side surface 31 which defines a second spiral waveguide passageway 32 associated with the first spiral waveguide passageway 28. More particularly, the first and the second spiral waveguide passageways 28 and 31 have faces which are identical in shape with each other so that the first and the second spiral waveguide passageways 28 and 31 may form an integral spiral waveguide passageway when put together.

Turning back to FIG. 1, the first receive filter part 21 has a first connection part 33 integrated to the first branching filter part 19, a first receive impedance transducer 34, and a first waveguide receive filter 35. The second receive filter part 22 has a second connection part 36 integrated to the second branching part 20, a second receive impedance transducer 37, and a second waveguide receive filter 38. The first connection part 33 is coupled to the second connection part 36. The first receive impedance transducer 34 is coupled to the second receive impedance transducer 37. The first waveguide receive filter 35 is coupled to the second waveguide receive filter 38.

In the manner known in the art, the transmit filter 14 has a transmit frequency pass band. The input transmit signal has a transmit frequency in the transmit frequency pass band. The receive filter 16 has a receive frequency pass band. The input receive signal has a receive frequency in the receive frequency pass band. The transmit frequency pass band is different from the receive frequency pass band.

Figure 3:
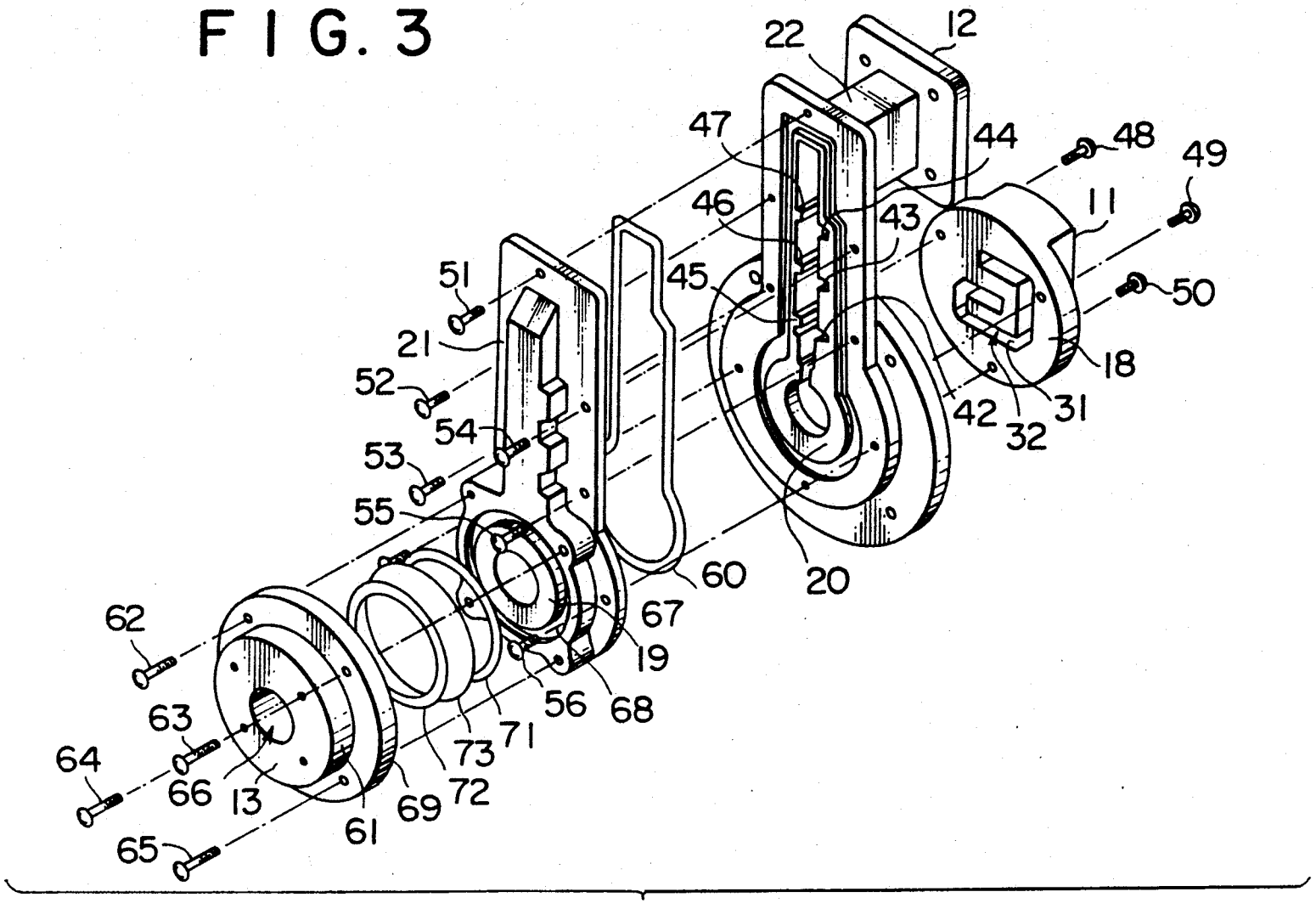
FIG. 3 is an exploded perspective view of the branching filter illustrated in FIG. 1.

Referring to FIG. 3 in addition to FIG. 1, the first receive filter part 21 has first through third cavities 39, 40, and 41 and first through third bosses (not shown). The second receive filter part 22 has fourth through sixth cavities 42, 43, and 44 and fourth through sixth bosses 45, 46, and 47.

The first through the third cavities 39, 40, and 41 are in one-to-one correspondence to the fourth through the sixth cavities 42, 43, and 44. The first through the third bosses are in one-to-one correspondence to the fourth through the sixth bosses 45, 46, and 47. The first through the third cavities 39, 40, and 41 are coupled to the fourth through the sixth cavities 42, 43, and 44. The first through the third bosses are coupled to the fourth through the sixth bosses 45, 46, and 47.

The second transmit filter part 18 is rendered integral with the first transmit filter part 17 by screws 48, 49, and 50. The first element 23 is coupled to the second element 24 by screws 51 to 56. The first element 23 has a first element surface 57 which, in turn, has a first element ditch 58. The first element surface 57 is opposed to a second element surface 59 of the second element 24. A gasket 60 is located in the first element ditch 58. The gasket 60 touches the second element surface 59 of the second element 24. A flange 61 is coupled to the first branching filter part 19 by screws 62 to 65. The flange 61 has a flange perforation 66 and the antenna port 13. A branching filter surface 67 of the first branching filter part 19 has a branching filter ditch 68. A flange filter surface 69 of the flange 61 has a flange ditch 70. A first ring 71 is located in the branching filter ditch 68. A second ring 72 is located in the flange ditch 70. An air-tight film 73 is interposed between the first branching filter part 19 and the flange 61 and between the first and the second rings 71 and 72.

Figure 4:
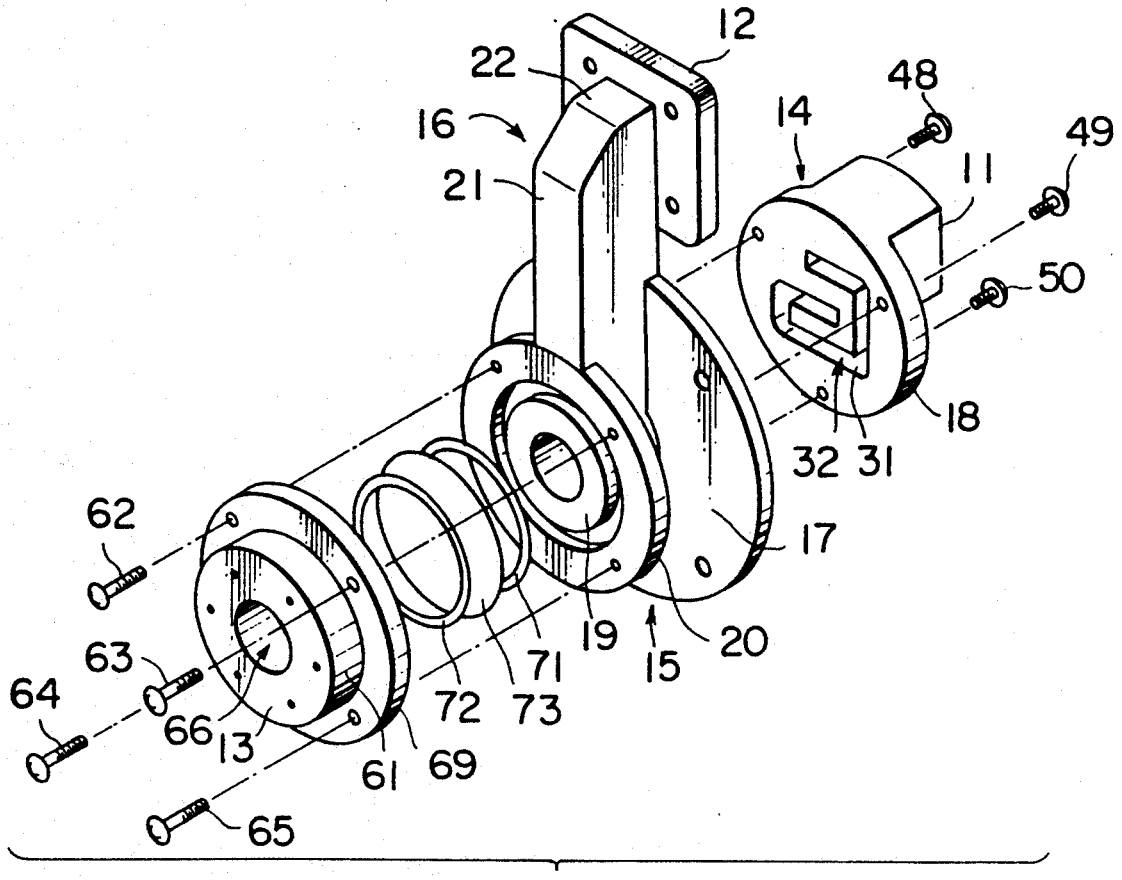
FIG. 4, drawn below FIG. 2 merely for convenience of illustration, is an exploded perspective view of a branching filter according to a second embodiment of this invention.

Referring to FIG. 4, the description will proceed to a branching filter according to a second embodiment of this invention. In FIG. 4, the branching filter comprises similar parts designated by like reference numerals. In the branching filter being illustrated, the first transmit filter part 17 is rendered integral with the waveguide branching filter 15. The first transmit filter part 17 is integral with the receive filter 16. The waveguide branching filter 15 is integral with the receive filter 16.

Figure 5:
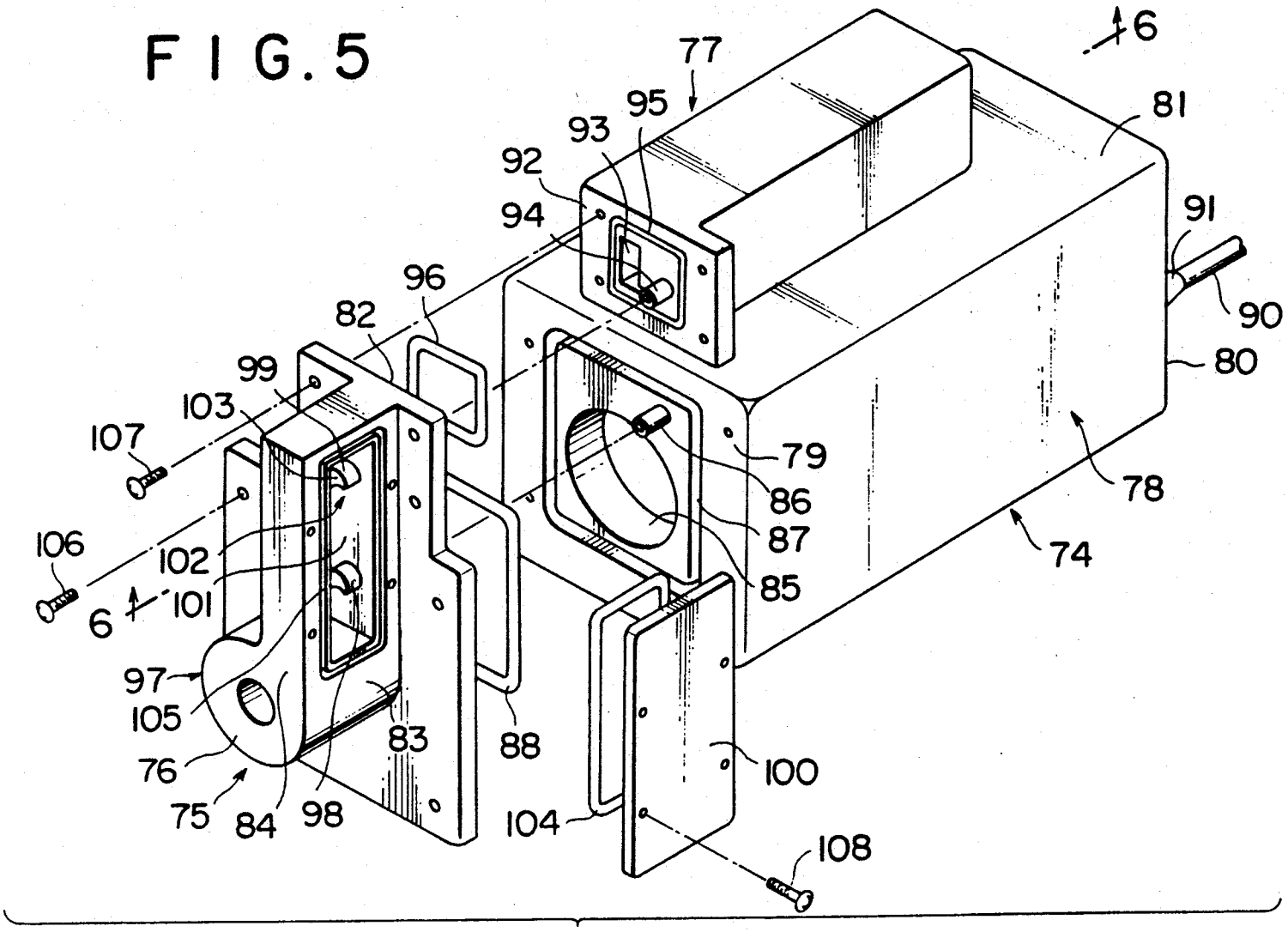
FIG. 5 is an exploded perspective view of a transmitter-receiver according to a third embodiment of this invention.
Figure 6:
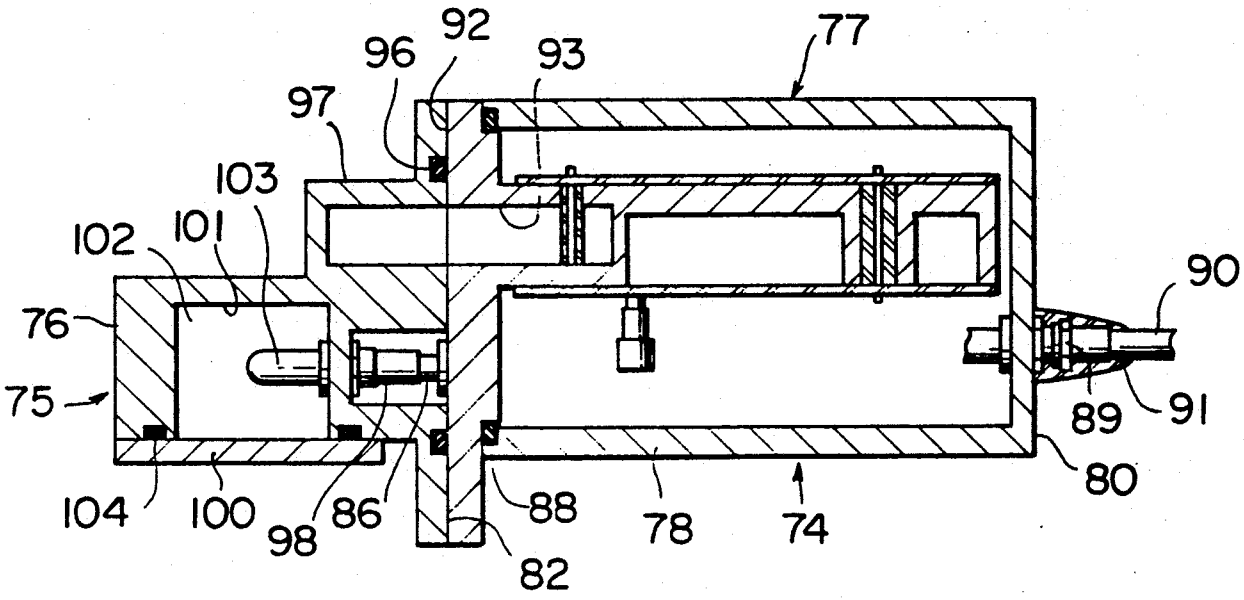
FIG. 6 is a cross-sectional view taken along a 6—6 line of FIG. 5.

Referring to FIGS. 5 and 6, the description will proceed to a transmitter-receiver according to a third embodiment of this invention. The transmitter-receiver comprises a transmitter module 74 for generating an input transmit signal, a branching filter module 75 having an antenna port 76 for receiving an input receive signal, and a receiver module 77. The input transmit and receive signals, as herein called, are similar to those described before.

The branching filter module 75 is connected to the transmitter module 74 and the receiver module 77 in the manner which will presently be described in detail. The branching filter module 75 receives the input transmit signal from the transmitter module 74 and the input receive signal at the antenna port 76 to distribute the input transmit signal to the antenna port 76 and the input receive signal to the receiver module 77 as the filtered receive signal.

The transmitter module 74 and the branching filter module 75 are located side by side. The transmitter module 74 comprises a transmitter case 78 having first through third transmitter surfaces 79, 80, and 81. Other transmitter surfaces need not be mentioned here. The branching filter module 75 has first through third branching filter surfaces 82, 83, and 84. The first transmitter surface 79 opposes to the first branching filter surface 82. The transmitter module 74 comprises a transmitter waveguide 85 and a first transmitter connector 86 which are located on the side of the first transmitter surface 79. The transmitter module 74 comprises a transmitter (not shown) which is connected to the transmitter waveguide 85. The first transmitter surface 79 has a first transmitter ditch 87 which surrounds the transmitter waveguide 85 and the first transmitter connector 86. A first packing 88 is located in the first transmitter ditch 87. The transmitter module 74 comprises an intermediate frequency transducer (not shown) connected to the transmitter and the first transmitter connector 86. The transmitter module 74 comprises a second transmitter connector 89 on the side of the second transmitter surface 80. The second transmitter connector 89 is connected to the intermediate frequency transducer and a first cable 90 which is for connection to a counterpart transmitter-receiver (not shown). The second transmitter connector 89 and a part of the first cable 90 are covered with an adhesive tape 91.

The receiver module 77 is located on the third transmitter surface 81 of the transmitter module 74. The receiver module 77 comprises a receiver (not shown). The receiver module 77 has a receiver surface 92 which opposes to the first branching filter surface 82. The receiver module 77 comprises a receiver waveguide 93 and a receiver connector 94 which are located on the side of the receiver surface 92. The receiver surface 92 has a first receiver ditch 95 which surrounds the receiver waveguide 93 and the receiver connector 94. A second packing 96 is located in the receiver ditch 95. The receiver waveguide 93 and the receiver connector 95 are connected to the receiver.

The branching filter module 75 comprises another waveguide branching filter 97 having the antenna port 76. The branching filter module 75 comprises a first branching connector 98 and a second branching connector 99 on the side of the first branching filter surface 82. The first branching connector 98 is connected to the transmitter connector 86. The second branching connector 99 is connected to the receiver connector 94.

The branching filter module 75 comprises a cover 100 and a circumferential wall 102. The circumferential wall 101 defines an installation hole 102. The installation hole 102 is opened on the side of the second branching filter surface 83. The installation hole 102 is for receiving a second cable 103 removably connected to the first and the second branching connectors 98 and 99. The installation hole 102 is covered with the cover 100. A third packing 104 is interposed between the cover 100 and the circumferential wall 101. The first and the second branching connectors 98 and 99 are covered for hermetic seal and for insuring waterproofness by the cover 100 and the third packing 104. The second branching filter surface 83 has a first branching filter ditch 105 which surrounds an edge of the installation hole 102. The third packing 104 is located in the first branching filter ditch 105.

The branching filter module 75 is coupled to the transmitter module 74 by screws 106. The branching filter module 75 is coupled to the receiver module 77 by screws 107. The first and the second packings 88 and 96 touch the first branching filter surface 82. The cover 100 is coupled to the waveguide branching filter 97 by screws 108.

The receiver receives the filtered receive signal from the branching filter module 75 through the receiver waveguide 93 to produce an output receive signal. The output receive signal is transmitted towards the counterpart transmitter-receiver through the receiver connector 94, the second branching connector 99, the second cable 103, the first branching connector 98, the first transmitter connector 86, the intermediate frequency transducer, the second transmitter connector 89, and the first cable 90.

Figure 7:
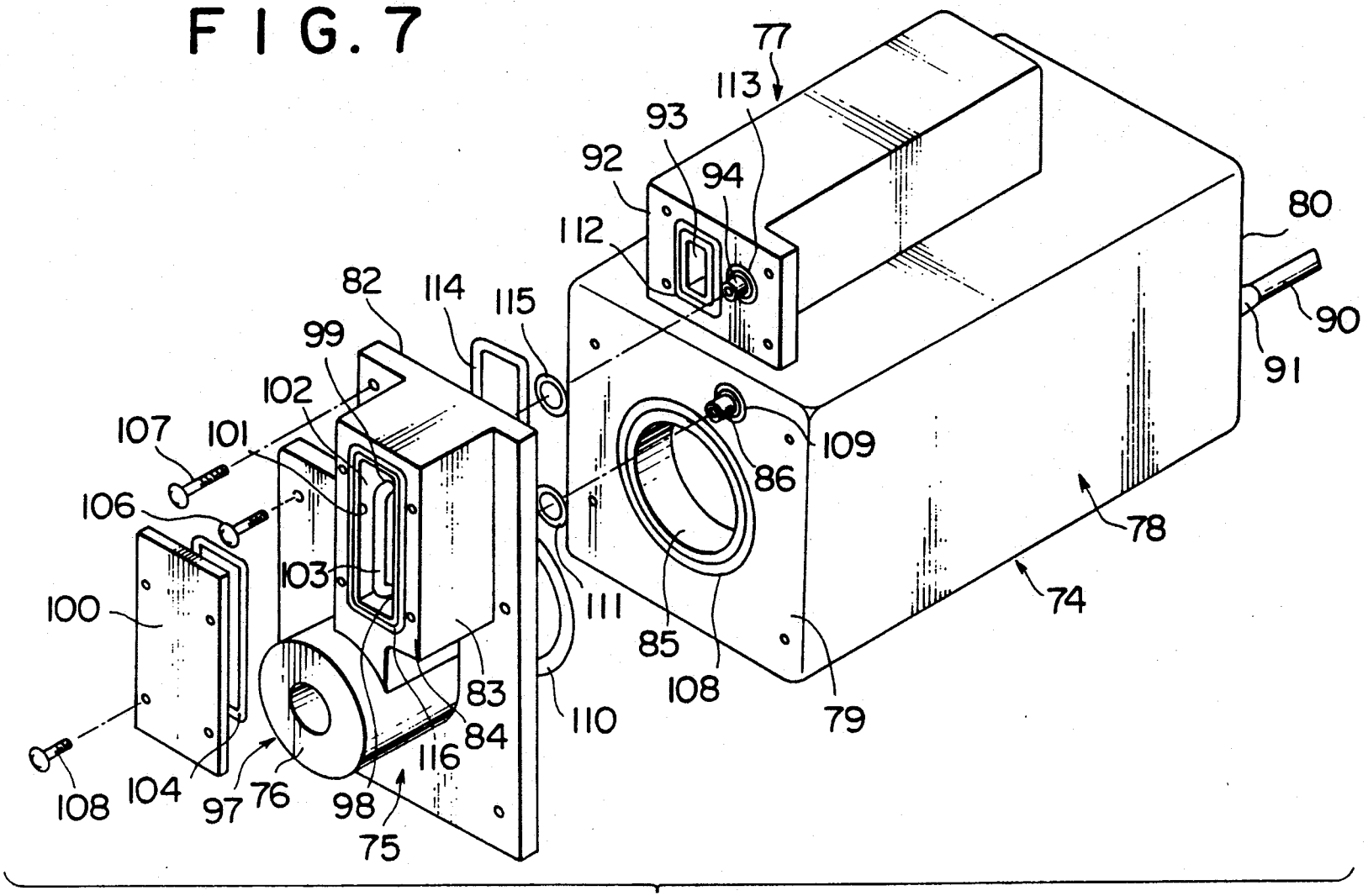
FIG. 7 is an exploded perspective view of a transmitter-receiver according to a fourth embodiment of this invention.

Referring to FIG. 7, the description will proceed to a transmitter-receiver according to a fourth embodiment of this invention. In FIG. 7, the transmitter-receiver comprises similar parts designated by like reference numerals. In the transmitter-receiver being illustrated, the first transmitter surface 79 has a second transmitter ditch 108 and a third transmitter ditch 109. The second transmitter ditch 108 surrounds the transmitter waveguide 85. The third transmitter ditch 109 surrounds the first transmitter connector 86. A fourth packing 110 is located in the second transmitter ditch 108. A fifth packing 111 is located in the third transmitter ditch 109. The fourth and the fifth packings 110 and 111 touch the first branching filter surface 82.

The receive surface 92 has a second receiver ditch 112 and a third receiver ditch 113. The second receiver ditch 112 surrounds the receiver waveguide 93. The third receiver ditch 113 surrounds the receiver connector 94. A sixth packing 114 is located in the second receiver ditch 112. A seventh packing 115 is located in the third receiver ditch 113. The sixth and the seventh packings 114 and 115 touch the first branching filter surface 82.

The installation hole 102 of the waveguide branching filter 97 is formed on the side of the third branching filter surface 84. The third branching filter surface 84 has a second branching filter ditch 116. The second branching filter ditch 116 surrounds an edge of the installation hole 102. The third packing 104 is located in the second branching filter ditch 116.

While this invention has thus far been described in conjunction with a few preferred embodiments thereof, it will now be readily possible for those skilled in the art to put this invention into practice in various other manners. For example, the branching filter module 75 may comprise the branching filter illustrated in FIG. 1. The branching filter module 75 may comprise the branching filter illustrated in FIG. 4.

What is claimed is:

1. A branching filter which has a transmitter port for receiving an input transmit signal, a receiver port transverse to said transmitter port, and an antenna port for receiving an input receive signal and which comprises a transmit filter, a waveguide branching filter, and a receive filter, wherein:

said transmit filter comprises first and second transmit filter parts, said waveguide branching filter comprising first and second branching filter parts, said receive filter comprising first and second receive filter parts, said first transmit filter part being integral with said second branching filter part, said first transmit filter part being integral with said second receive filter part, said second branching filter part being integral with said second receive filter part, said first branching filter part being integral with said first receive filter part;

said first and said second transmit filter parts being for filtering said input transmit signal into a filtered transmit signal, said first and said second branching filter parts being for receiving said filtered transmit signal and said input receive signal to distribute said filtered transmit signal to said antenna port and said input receive signal to said receive filter, said first and said second receive filter parts being for passing said input receive signal to said receiver port.

2. A branching filter which has a transmitter port for receiving an input transmit signal, a receiver port, and an antenna port for received input signals, comprising a transmit filter, a waveguide branching filter, and a receive filter, wherein:

said transmit filter comprises first and second transmit filter parts, said waveguide branching filter comprising first and second branching filter parts, said receive filter comprising first and second receive filter parts, said first transmit filter part having a first inner side surface which defines a first spiral waveguide passageway, said second transmit filter part having a second inner side surface which defines a second spiral waveguide passageway associated with said first spiral waveguide passageway, said first transmit filter part being integral with said second branching filter part, said first transmit filter part being integral with said second receive filter part, said second branching filter part being integral with said second receive filter part, said first branching filter part being integral with said first receive filter part;

said first and said second transmit filter parts filtering said input transmit signal into a filtered transmit signal, said first and said second branching filter parts receiving said filtered transmit signal and said input receive signal to distribute said filtered transmit signal to said antenna port and said input receive signal to said receive filter, said first and said second receive filter parts passing said input receive signal to said receiver port.

3. A branching filter which has a transmitter port for receiving an input transmit signal, a receiver port transverse to said transmitter port, and an antenna port for receiving an input receive signal and which comprises a transmit filter, a waveguide branching filter, and a receive filter, wherein:

said transmit filter comprises first and second transmit filter parts, said first transmit filter part being integral with said waveguide branching filter, said first transmit filter part being integral with said receive filter, said waveguide branching filter being integral with said receive filter;

said first and said second transmit filter parts being for filtering said input terminal signal into a filtered transmit signal, said waveguide branching filter being for receiving said filtered transmit signal and said input receive signal to distribute said filtered transmit signal to said antenna port and said input receive signal to said receive filter, said receive filter being for passing said input receive signal to said receiver port.

4. A branching filter which has a transmitter port for receiving an input transmit signal, a receiver port, and an antenna port for received input signals, comprising a transmit filter, a waveguide branching filter, and a receive filter, wherein:

said transmit filter comprises first and second transmit filter parts, said first transmit filter part having a first inner side surface which defines a first spiral waveguide passageway, said second transmit filter part having a second inner side surface which defines a second spiral waveguide passageway associated with said first spiral waveguide passageway, said first transmit filter part being integral with said waveguide branching filter, said first transmit filter part being integral with said receive filter part, said waveguide branching filter being integral with said receive filter;

said first and second transmit filter parts filtering said input terminal signal into a filtered transmit signal, said waveguide branching filter receiving said filtered transmit signal and said input receive signal to distribute said filtered transmit signal to said antenna port and said input receive signal to said receive filter, said receive filter passing said input receive signal to said receiver port.

5. A transmitter-receiver comprising a transmitter module for generating an input transmit signal, a branching filter module having an antenna port for receiving an input receive signal, and a receiver module, said branching filter module being for receiving said input transmit signal and said input receive signal to distribute said input transmit signal to said antenna port and said input receive signal to said receiver module, wherein:

said transmitter module comprises a transmitter connector, said receiver module comprising a receiver connector, said branching filter module serving as a waveguide branching filter comprising a first branching connector connected to said transmit connector, a second branching connector connected to said receiver connector, a cover, and a circumferential wall defining an installation hole which is for receiving a cable and is covered with said cover with a packing interposed between said cover and said circumferential wall.

6. A transmitter-receiver as claimed in claim 5, said branching filter module having a transmitter port for receiving an input transmit signal, a receiver port, and an antenna port for receiving an input receive signal and which comprises a transmit filter, a waveguide branching filter, and a receive filter, wherein:

said transmit filter comprises first and second transmit filter parts, said waveguide branching filter comprising first and second branching filter parts, said receive filter comprising first and second receive filter parts, said first transmit filter part being integral with said second branching filter part, said first transmit filter part being integral with said second receive filter part, said second branching filter part being integral with said second receive filter part, said first branching filter part being integral with said first receive filter part;

said first and said second transmit filter parts being for filtering said input transmit signal into a filtered transmit signal, said first and said second branching filter parts being for receiving said filtered transmit signal and said input receive signal to distribute said filtered transmit signal to said antenna port and said input receive signal to said receive filter, said first and said second receive filter parts being for passing said input receive signal to said receiver port.

7. A transmitter-receiver as claimed in claim 5, said branching filter module having a transmitter port for receiving an input transmit signal, a receiver port, and an antenna port for receiving an input receive signal and which comprises a transmit filter, a waveguide branching filter, and a receive filter, wherein:

said transmit filter comprises first and second transmit filter parts, said first transmit filter part being integral with said waveguide branching filter, said first transmit filter part being integral with said receive filter, said waveguide branching filter being integral with said receive filter;

said first and said second transmit filter parts being for filtering said input terminal signal into a filtered transmit signal, said waveguide branching filter being for receiving said filtered transmit signal and said input receive signal to distribute said filtered transmit signal to said antenna port and said input receive signal to said receive filter, said receive filter being for passing said input receive signal to said receiver port.

* * * * *